US010550590B2

(12) United States Patent
Titcomb

(10) Patent No.: US 10,550,590 B2
(45) Date of Patent: Feb. 4, 2020

(54) CONCRETE FORMING SYSTEM FILLER BARS WITH BOLT PLATE ASSEMBLY

(71) Applicant: Titcomb Brothers Manufacturing, Inc., Westport, MA (US)

(72) Inventor: Paul S. Titcomb, Marion, MA (US)

(73) Assignee: Titcomb Brothers Manufacturing, Inc., Westport, MA (US)

( * ) Notice: Subject to any disclaimer, the term of this patent is extended or adjusted under 35 U.S.C. 154(b) by 192 days.

(21) Appl. No.: 15/878,283

(22) Filed: Jan. 23, 2018

(65) Prior Publication Data

US 2018/0216356 A1 Aug. 2, 2018

Related U.S. Application Data

(60) Provisional application No. 62/449,248, filed on Jan. 23, 2017.

(51) Int. Cl.
*E04G 11/08* (2006.01)
*E04G 17/04* (2006.01)

(52) U.S. Cl.
CPC ..... *E04G 11/087* (2013.01); *E04G 17/04* (2013.01)

(58) Field of Classification Search
CPC ..... E04G 11/087; E04G 17/042; E04G 17/04
USPC ..... 249/44, 47, 191, 192, 193
See application file for complete search history.

(56) References Cited

U.S. PATENT DOCUMENTS 1,292,986 A * 2/1919 Annbursen ..... E04G 11/46 249/30
1,306,384 A * 6/1919 McKay ..... E04G 17/04 249/193
3,236,490 A * 2/1966 Lovgren ..... E04G 17/0754 249/45
3,288,427 A * 11/1966 Pluckebaum ..... E04G 9/02 249/192
4,030,694 A * 6/1977 Schimmel ..... E04G 11/087 249/196
4,033,544 A * 7/1977 Johnston ..... E04G 17/047 249/40
4,192,481 A * 3/1980 Durbin ..... E04G 11/12 249/191
4,356,993 A * 11/1982 Gallis ..... E04G 17/042 249/27
5,552,103 A * 9/1996 Lee ..... E04G 11/087 249/193

(Continued)

FOREIGN PATENT DOCUMENTS

EP 0062420 A1 * 10/1982 ..... E04G 9/052

*Primary Examiner* — Michael Safavi
(74) *Attorney, Agent, or Firm* — Nelson Mullins Riley & Scarborough LLP; Anthony A. Laurentano

(57) ABSTRACT

A filler panel assembly for use with a concrete forming system comprising one or more filler bar assemblies having a panel element disposed therebetween. Each of the filler bar assemblies is secured to the panel element. Each filler bar assembly includes a filler bar having a flange portion and a longitudinally extending and one or more bolt plate assemblies. Each bolt assembly includes a bolt plate having a main body that has an aperture formed therein and a pair of opposed flanges that are formed in a front surface of the main body and which extend outwardly from a rear surface thereof, a nut element, and a shoulder bolt element.

8 Claims, 6 Drawing Sheets

(56) References Cited

U.S. PATENT DOCUMENTS 5,656,193 A * 8/1997 Lopez ..... E04G 13/023
249/158
5,965,053 A * 10/1999 Carlson ..... E04G 17/002
249/191

* cited by examiner

CONCRETE FORMING SYSTEM FILLER BARS WITH BOLT PLATE ASSEMBLY

RELATED APPLICATION

This application claims priority to provisional patent application Ser. No. 62/449,248, entitled Filler Bars with Bolt Plate Assembly, filed on Jan. 23, 2017, the contents of which are herein incorporated by reference.

FIELD OF THE INVENTION

The present invention is related to the fabrication of concrete walls, such as for home foundations, using suitable concrete forms, and particularly relates to a device and apparatus employed in connection with the concrete forms for forming the concrete walls.

BACKGROUND OF THE INVENTION

Conventional concrete walls may be created by pouring concrete into a suitable concrete form. As is known in the art, concrete foundation walls are generally poured between two sets of concrete forms disposed in essentially parallel relationship and defining therebetween a channel having a dimension for the desired thickness of the concrete wall. Such opposed, spaced apart walls are generally held in a fixed relationship relative to each other against the immense weight of any poured concrete by tie-wires and turnbuckle assemblies having abutment surfaces against which a locking or latching arm on adjacent form sections abut. Once assembled into the shape of the wall, wet concrete is poured into the channel formed between the concrete forms and allowed to cure. The concrete forms typically comprise multiple form panels, which may for example be formed of wood or any other suitable well known material. The height of the form panel may vary by application.

Multiple form panels may be placed side-by-side in order to construct a wall of a desired length. Because the wet poured concrete takes the shape of the forms in which it is placed, the finished concrete wall corresponds in configuration to the assembled form. Therefore, it is important to align precisely the panels composing the concrete form in order to ensure that the finished wall has the desired appearance and strength.

Another problem that can occur when employing concrete forms involves straightening the panels so that they do not lean inwards or outwards. For this purpose, and for securing the panels together, some panels include one or more panel bars that extend horizontally across the panel. The panel bars may be, for example, metal bars about two inches wide that are affixed to the form panel. If multiple panel bars are provided on a single panel, they may be spaced at predetermined locations along the height of the form panel. The panel bar may include a latch or lever that allows the panels to be clipped together side-by-side, as well as a plurality of shoulder bolts. The shoulder bolts are sized to interface and cooperate with the latch of the latch assembly thus securing together adjacent panels.

The concrete forms are generally formed in selected or standard heights and widths and are arranged in series as an assembly to form the outline of the foundation wall. Thus, if a section of the concrete form assembly requires a form of a non-standard size (e.g., not the width of the standard forms), then the contractor typically modifies an existing concrete form, such as by cutting, to match the needed size and shape. This unfortunately sacrifices a reusable concrete form for a one-time use.

SUMMARY OF THE INVENTION

The present invention is directed to a filler panel assembly for use with a concrete forming system comprising one or more filler bar assemblies having a panel element disposed therebetween and one or more bolt plate assemblies. Each of the filler bar assemblies is secured to the panel element, and wherein each of the filler bar assemblies includes a filler bar having a main body that extends in a longitudinal direction and has a front surface and an opposed rear surface, the main body having a flange portion that extends outwardly therefrom on one side of the filler bar, and a longitudinally extending channel formed in the front surface, wherein the channel has an opening and the opening has a pair of opposed lip portions formed thereon on either side of the opening.

The bolt plate assembly includes a bolt plate having a main body that has an aperture formed therein and a pair of opposed flanges that are formed in a front surface of the main body and which extend outwardly from a rear surface thereof, wherein the flanges are sized and configured for seating within the channel of the filler bar to position the bolt plate relative to the channel and enable the bolt plate to slide longitudinally along and within the channel so that a user can position the bolt plate assembly at a selected location along the channel, a nut element having a main body with an aperture formed therein, and wherein the nut element is sized and configured for seating within the channel of the filler bar, and a shoulder bolt element sized and configured for seating within the aperture of the bolt plate.

According to one practice, the flange portion has a front surface that has a plurality of fastener-receiving apertures formed therein for seating fasteners. The fasteners secure the panel element to the flange portion of the filler bar. The flange portion also has a rear surface opposite the front surface that has an inset region formed therein.

According to another practice, the channel has a generally T-shaped configuration, and the opening of the channel and the pair of opposed lip portions form a capture mechanism to retain the bolt plate assembly.

The shoulder bolt element has a main body having a head portion and a shaft portion, where the shaft portion includes a non-threaded portion disposed adjacent the head portion and a distal threaded portion, and wherein the non-threaded portion of the shaft has a diameter that is greater than the diameter of the threaded portion of the shaft.

The filler bar panel also includes a latch element having a main body with an aperture formed at one end of the main body that is adapted to seat a portion of the shaft of the shoulder bolt and one or more grooves. The latch element is adapted to freely swing when mounted to the shoulder bolt so as to seat on a shoulder bolt of an adjacent concrete form.

According to an alternate embodiment of the present invention, a filler panel assembly for use with a concrete forming system includes a filler bar having a main body that extends in a longitudinal direction and has a front surface and an opposed rear surface. The main body has at least two longitudinally extending channels formed in the front surface, where each of the channels has an opening and the opening has a pair of opposed lip portions formed thereon on either side of the opening. The filler panel assembly also includes one or more bolt plate assemblies that include a bolt plate having a main body that has an aperture formed therein and a pair of opposed flanges that are formed in a front surface of the main body and which extend outwardly from a rear surface thereof, wherein the flanges are sized and configured for seating within the channel of the filler bar to position the bolt plate relative to the channel and enable the bolt plate to slide longitudinally along and within the channel so that a user can position the bolt plate assembly at a selected location along the channel, a nut element having a main body with an aperture formed therein, and wherein the nut element is sized and configured for seating within the channel of the filler bar, and a shoulder bolt element sized and configured for seating within the aperture of the bolt plate.

The exemplary embodiments will now be described in detail with reference to the attached drawings.

BRIEF DESCRIPTION OF THE DRAWINGS

These and other features and advantages of the present invention will be more fully understood by reference to the following detailed description in conjunction with the attached drawings in which like reference numerals refer to like elements throughout the different views. The drawings illustrate principals of the invention and, although not to scale, show relative dimensions.

DETAILED DESCRIPTION

Figure 1:
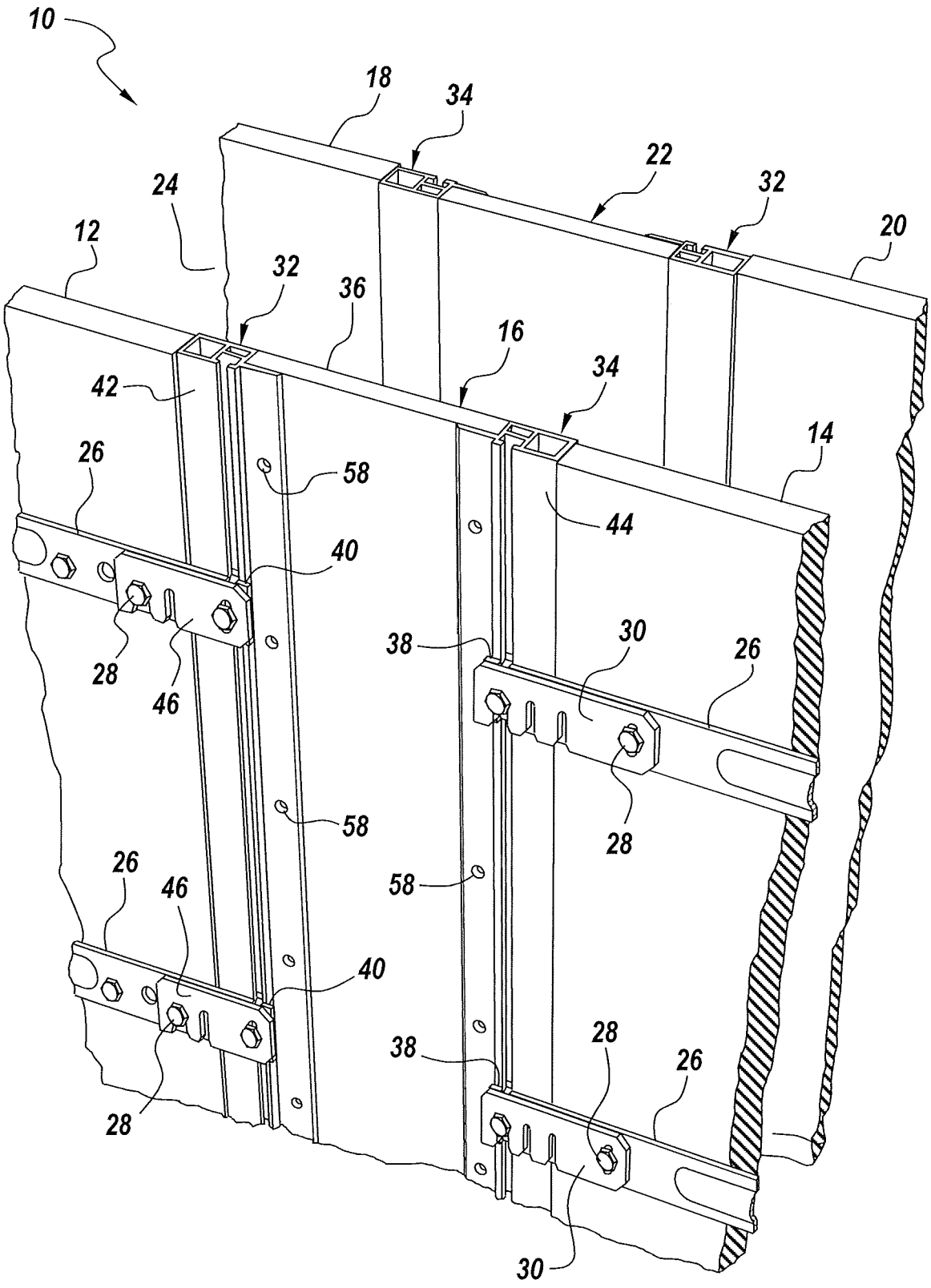
FIG. 1 is a partial perspective view of a concrete forming system employing the filler panel assembly of the present invention.
Figure 2:
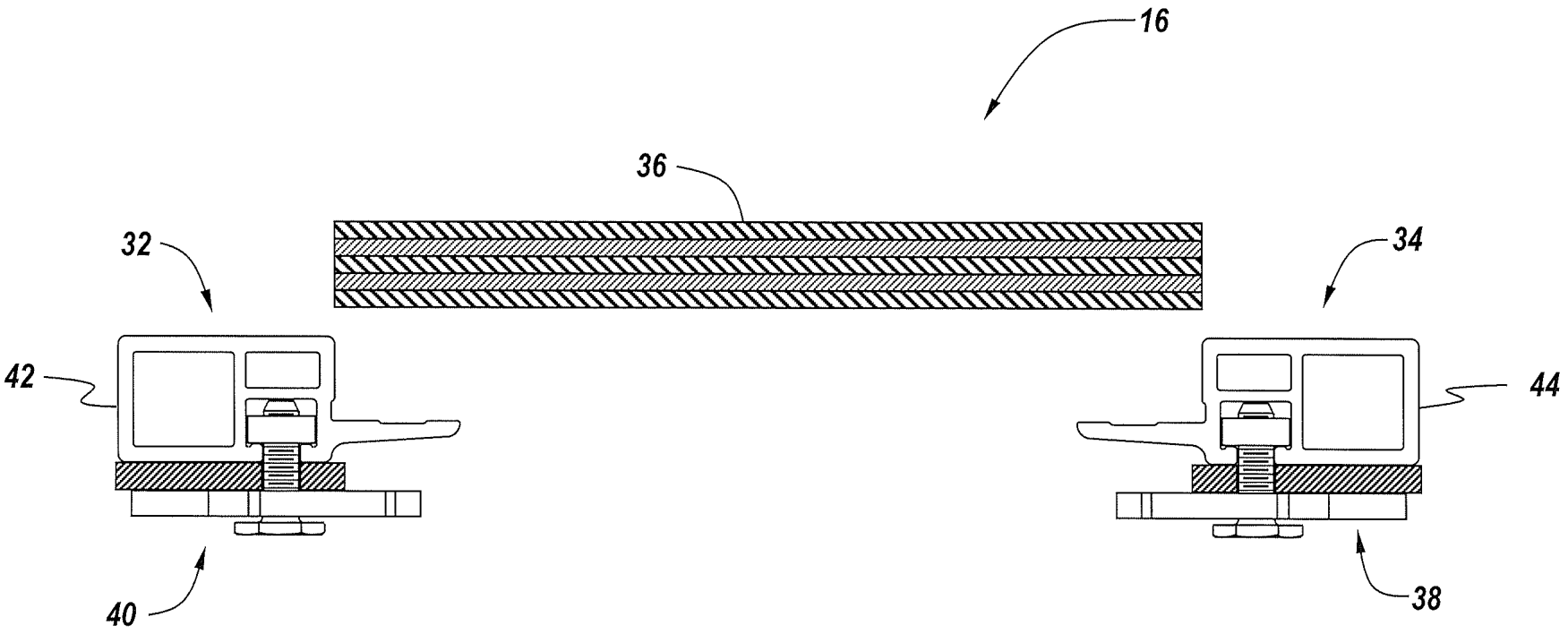
FIG. 2 is a cross-sectional view, partially unassembled, of the filler panel assembly showing the various sub-assemblies according to the teachings of the present invention.
Figure 3:
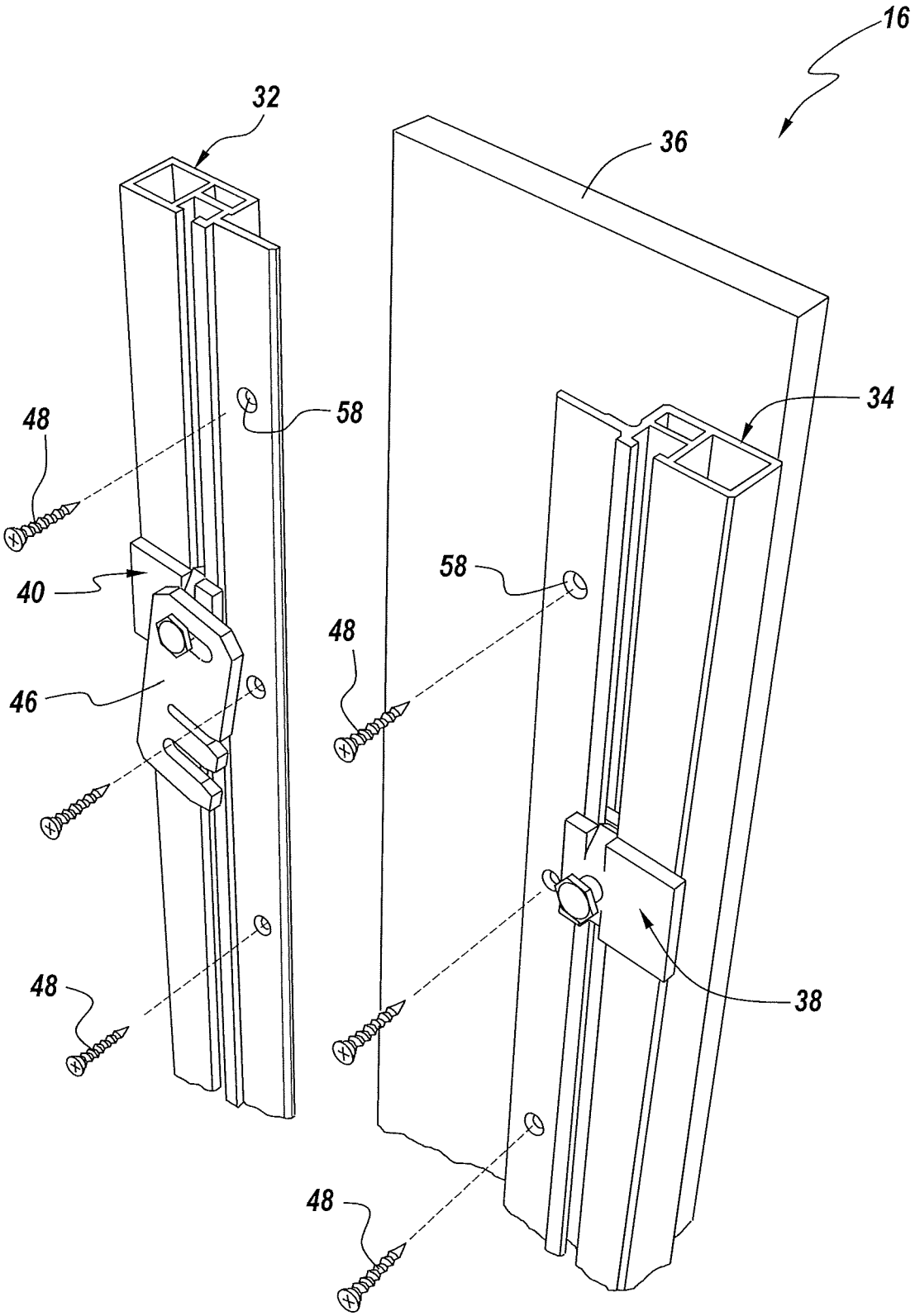
FIG. 3 is a partial perspective view of the filler panel assembly of FIGS. 1 and 2 according to the teachings of the present invention.
Figure 4:
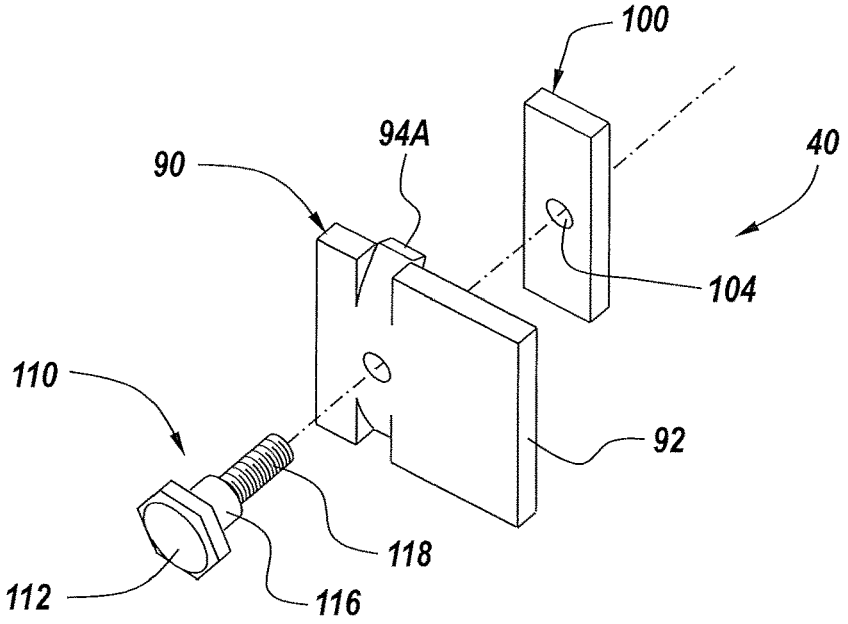
FIG. 4 is an exploded perspective view of a bolt plate assembly portion of the filler bar assembly according to the teachings of the present invention.
Figure 5:
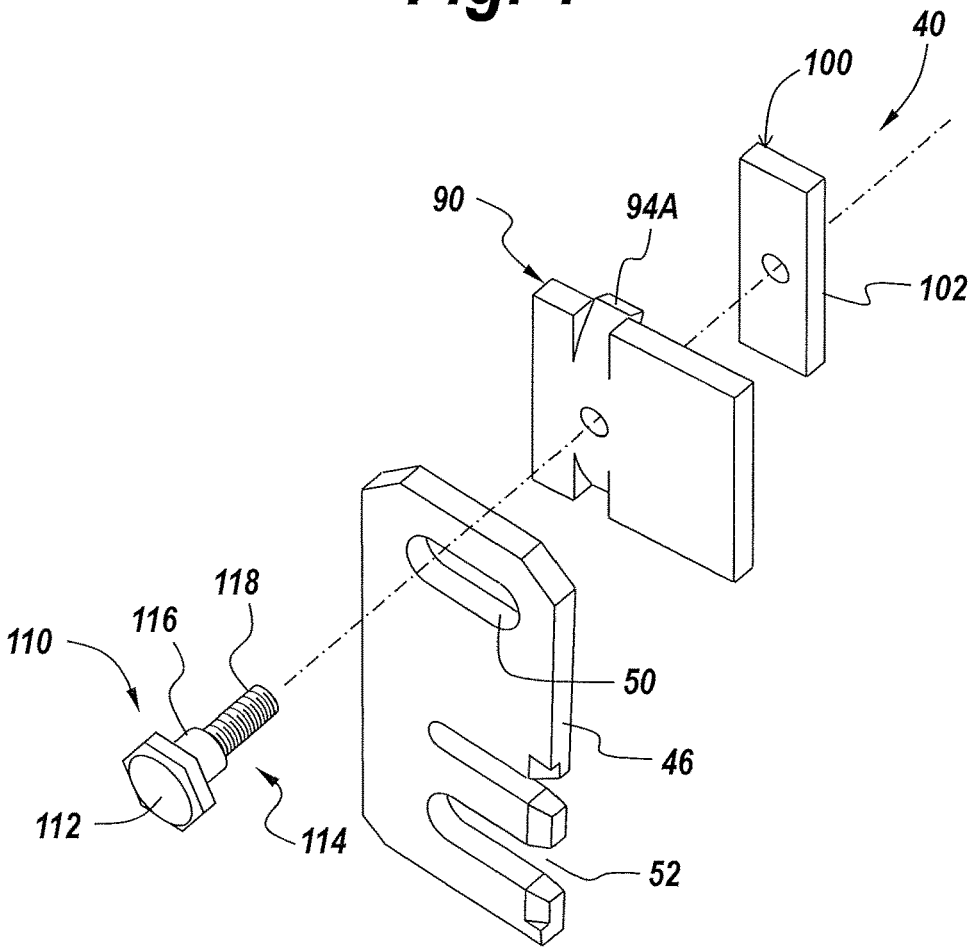
FIG. 5 is an exploded perspective view of a bolt plate assembly portion of the filler bar assembly showing a latch element coupled thereto according to the teachings of the present invention.
Figure 6:
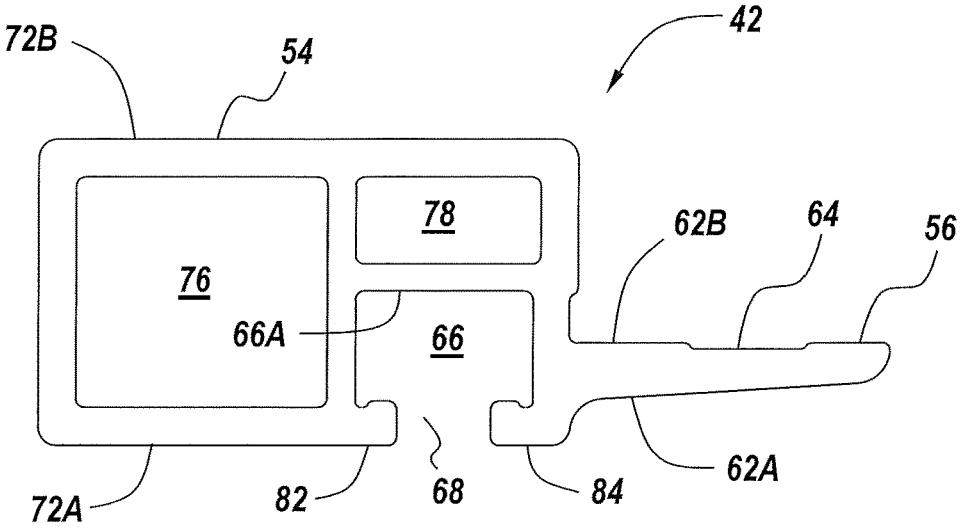
FIG. 6 is a cross-sectional view of a filler bar portion of the filler bar assembly according to the teachings of the present invention.
Figure 7A:
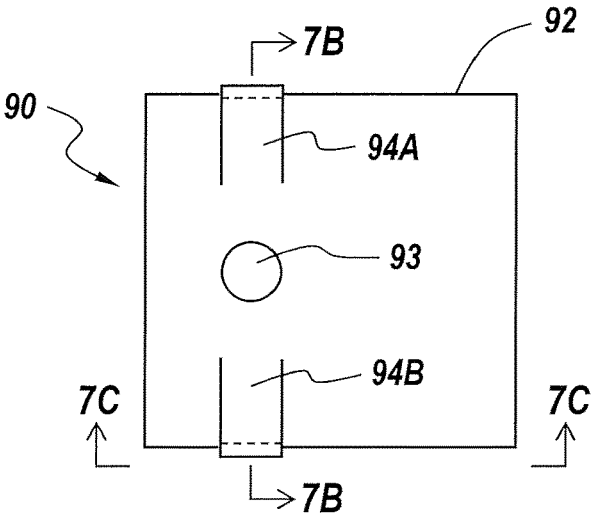
FIG. 7A is a top view of a bolt plate of the bolt plate assembly according to the teachings of the present invention.
Figure 7B:
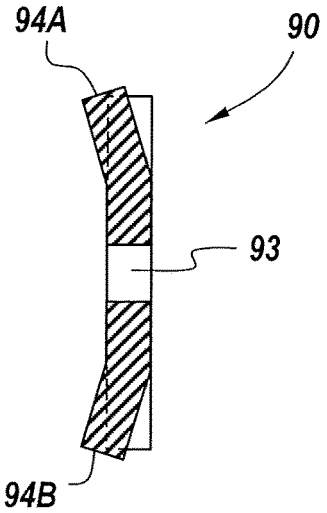
FIG. 7B is a cross-sectional view of the bolt plate of the bolt plate assembly according to the teachings of the present invention.
Figure 7C:
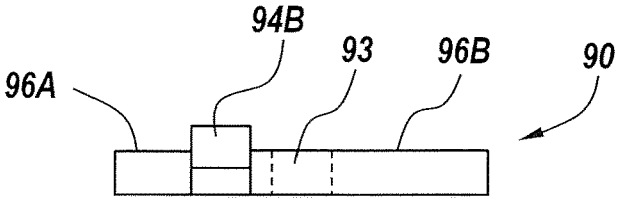
FIG. 7C is a side view of the bolt plate of the bolt plate assembly according to the teachings of the present invention.

FIGS. 1-3 illustrate a portion of a concrete forming system 10 according to the teachings of the present invention. The concrete forming system 10 includes for the sake of illustration a pair of outer concrete forms 12, 14 and an outer filler panel assembly 16 that form one wall, such as an outer wall, of a concrete wall to be constructed or formed. Similarly, the system includes a pair of inner concrete forms 18, 20 and an inner filler panel assembly 22 that form an inner wall of the concrete wall to be formed. The inner and outer concrete forms are spaced apart and define a space or channel 24 therebetween. A concrete mixture can be poured in the space formed between the forms and allowed to harden or cure into the concrete wall. The concrete wall can form part of a foundation for a suitable structure, such as a home. Those of ordinary skill in the art will readily recognize that any selected number of adjacent concrete forms can be used to form the outer and inner walls depending upon the size and overall length of the concrete wall to be built. For the sake of simplicity, only a pair of forms is illustrated. The concrete forms can have any selected shape and are preferably in the shape of a panel. The typical concrete form can be composed of plywood with a selected overlay material secured thereto. The panel can have any selected thickness, and preferably has a thickness of about 1.125 inches.

The concrete forms 12 and 14 can each have attached thereto one or more panel bars. As illustrated, a plurality of panel bars 26 can be attached to each concrete form 12, 14. The panel bars have associated therewith a plurality of shoulder bolts. As illustrated, each of the panel bars 26 has located at an end portion thereof one or more shoulder bolts 28. A lever or latch mechanism 30 can also be provided and formed on one end of a concrete form 14 and has a selected configuration that allows the latch 30 to engage a shoulder bolt 28 formed on an adjacent concrete form, such as concrete form 12 if the filler panel assembly was not used, or on the filler panel assembly 16, 22 as described in further detail below. The concrete forming system 10 can also employ a turnbuckle brace assembly (not shown) for helping to support and if necessary align the concrete forms and/or ensure that the panels are not out of plumb. An example of a suitable turnbuckle assembly for use with the present invention is shown and described in U.S. Ser. No. 15/013,259, entitled Turnbuckle Clip For Use With Concrete Forming Products, to the assignees hereof, the contents of which are herein incorporated by reference.

The illustrated filler panel assemblies 16, 22 each include a pair of opposed filler bar assemblies 32 and 34 that are coupled to a panel element 36 via any suitable fasteners, such as fasteners 48. The filler bar assemblies 32, 34 can be coupled or secured to the panel by any suitable fasteners, such as by screws. The panel element 36 can be made of any suitable material, such as wood. The panel element can also have a thickness that is smaller than the thickness of the concrete forms 12, 14, and preferably has a thickness of 0.75 inches. The filler bar assemblies 32, 34 each include a filler bar 42, 44 and one or more associated bolt plate assemblies 38, 40. For example, the filler bar assembly 32 includes a filler bar 32 that mounts a plurality of bolt plate assemblies 40. The number of bolt plate assemblies can typically match the number of panel bars provided on the adjacent concrete form 12. The bolt plate assembly 40 can include, among other structure described in further detail below, a latch element 46. The filler bar assembly 34 includes a filler bar 34 that also mounts a plurality of bolt plate assemblies 38. The number of bolt plate assemblies typically matches the number of panel bars provided on the adjacent concrete form 14.

The various components of the filler bar assemblies 32, 34 are shown in further detail in FIGS. 4-7C. The illustrated filler bar assembly 32 and bolt plate assembly 40 will be described in further detail below for the sake of simplicity. As shown in FIGS. 1-3 and 6, the filler bar 42 of the filler bar assembly 32 has a main body 54 that has an outwardly projecting flange portion 56. The flange portion 56 has a front surface 62A that has a series of fastener-receiving apertures 58 formed therein for seating the fasteners 48. The fasteners 48 secure the panel to the flange portion 56 of the filler bar 42. The flange portion also includes a rear surface 62B that has a shallow inset region or portion 64 formed therein. The main body 54 of the filler bar also has a front surface 72A and an opposed rear surface 72B. The main body has an axially or longitudinally extending channel 66 formed in the front surface 72A. The channel 66 can have any selected shape or size, and is preferably has a generally or substantially T-shaped configuration. The channel 66 has an opening 68 that is formed in a front surface 72A of the main body. The opening has a pair of opposed lip portions 82, 84 formed on either side of the opening 68 and serve to function as a capture mechanism, along with the channel 66, to retain the bolt plate assembly 40. The channel 66 and the illustrated chamber 78 are formed along a side of the main body that is adjacent the flange 56. The main body 54 also has one or more hollows or chambers formed therein, such as chambers 76, 78. The chamber 78 and the channel 66 are formed in a stacked configuration in a width direction such that a floor portion 66A of the channel 66 forms a common wall portion of the chamber 78. The filler bar 34 has a construction similar to the filler bar 32, except that the filler bar features are formed in a reverse manner. Further details of the filler bar 34 need not be described herein.

As shown in FIGS. 2, 4-5, and 7A-7C, the filler bar assembly 32 further includes one or more bolt plate assemblies 40. The bolt plate assembly 40 includes for example a bolt element or plate 90, a nut element or plate 100, and a shoulder bolt element 110. The bolt plate 90 has a main body 92 that has an aperture 93 formed therein. The aperture is sized and configured for receiving a portion of the shoulder bolt 110. The main body 92 also has formed therein a pair of opposed flanges 94A and 94B that are formed in or from a front surface 96A of the main body and which extend outwardly from a rear surface 96B thereof. The flanges 94A, 94B are sized and configured for seating within the opening 68 of the channel 66 of the filler bar 42. The flanges help position the bolt plate relative to the channel and enable the bolt plate to axially slide along the channel so that a user can position the bolt plate assembly at a selected location.

The illustrated shoulder bolt element 110 has a main body having a head portion 112 and a shaft portion 114. The head portion can have any selected shape, and preferably has a hexagonal shaped head. The shaft portion 114 of the shoulder bolt element includes a non-threaded portion 116 disposed adjacent the head portion 112 and a distal threaded portion 118. The non-threaded portion 116 of the shaft 114 has a thickness or diameter that is greater than the thickness or diameter of the threaded portion 118 of the shaft 114.

The illustrated bolt plate assembly 40 further includes a nut plate 100 that includes a main body having an aperture 104 formed therein. The aperture 104 is sized and configured for seating the threaded portion 118 of the shoulder bolt element 110. According to one practice, the aperture 104 can be a threaded aperture for threadingly mating a threaded portion of the shoulder bolt element. The nut plate main body is sized and configured for seating within the channel 66 of the filler bar 32.

The bolt plate assembly can further include if desired the latch element 46. The latch element 46 includes a main body having an aperture 50 formed at one end of the main body that is adapted to seat a portion of the shaft 114 of the shoulder bolt, and specifically accommodates the non-threaded portion 116 of the shaft 114. The latch element 46 is adapted to freely swing when mounted to the shoulder bolt so that it can seat or mount on a shoulder bolt of an adjacent concrete form. Specifically, the latch element can have one or more grooves, such as groove 52, formed at an opposed end of the main body for seating on the shoulder bolt. The latch elements allow the concrete forms or panels to be clipped together side-by-side to form the concrete forming wall.

The filler bars 42 and 44 are preferably formed of aluminum, and the components of the bolt plate assembly are made of metal.

In use, when a concrete wall is being formed by the use of the illustrated concrete forming system 10, the concrete forms and associated panel bars are positioned in place. If a width of a wall portion is needed that is less than the width of a conventional concrete form, then the filler panel assembly of the present invention can be used. The filler bar assemblies 32, 34 can be mounted to a panel 36 of a selected size via the fasteners 48. The bolt plate assemblies 38 and 40 can be mounted to the filler bars 34, 32 respectively. Specifically, with regard to filler bar 32, the bolt plate assemblies 40 can also include a latch element 46, thus forming a latch assembly, FIG. 5. The number of latch assemblies employed on the filler bar 32 can correspond in number to the number of panel bars 26 employed on the adjacent concrete form or panel 12. The latch assemblies are assembled by placing the nut plate 100 in the channel 66 of the filler bar 32. The bolt plate 90 is then placed over the channel portion 66 of the filler bar 32, such that the flange portions 94A, 94B of the bolt plate seat within the opening 68 and contact the nut plate. The latch element 46 is then disposed over the bolt plate 90. In this arrangement, the apertures 50, 93, and 104 are aligned. The shaft 114 of the shoulder bolt element 110 is then inserted through the aligned apertures and is threaded through the threaded aperture 104 of the nut plate 100. The diameters of the apertures 93 and 104 are sized to accommodate the threaded portion 118 of the shaft 114 but are smaller than the diameter of the non-threaded portion 116 of the shaft. As such, the non-threaded portion 116 of the shaft does not pass through the aperture 93 of the bolt plate 90 and hence seats on the front surface 96A of the bolt plate. The aperture 50 of the latch element 46 is sized so as to accommodate the non-threaded portion of the shaft, and when the shaft is mounted therein, the latch element seats on the non-threaded portion 116 of the shaft. The latch assembly can be axially moved within the channel 66 and positioned adjacent a corresponding panel bar 26 formed on the adjacent concrete form 12. When the latch assembly is positioned at the desired location, the shoulder bolt is tightened to as to secure the latch assembly in place. The latch element can swing freely about the non-threaded portion of the shoulder bolt, and is preferably moved by the user such that the groove 52 of the latch element is placed over the shoulder bolt 28 of the panel bar 26. Additional latch assemblies can be assembled and positioned in the channel 66 of the filler bar 32 as described above.

Likewise, the bolt plate assemblies 40 that are coupled to the filler bar 34 are assembled and positioned in a similar manner, but without the use of a latch element. When assembled as such, latch element or mechanism 30 of the adjacent panel bars 26 mounted to the adjacent concrete form or panel 26 are positioned so as to engage the shoulder bolt 110. The latch elements 46 and 30 thus help secure the filler panel assembly 16 to the adjacent concrete forms 12, 14 during use.

Those of ordinary skill in the art will readily recognize that each of the filler bars can have any selected shape or configuration depending upon the intended use of the product. For example, the main body of the filler bar can be differently configured if the filler bar is used at a corner of the concrete forming system. Further, the panel element disposed between the filler bar assemblies can have any selected width. According to alternate embodiments, the filler panel assembly can employ a single filler bar assembly if desired depending upon the specific use in the concrete forming system. For example, a single filler bar assembly can be employed if the attached panel element is configured to abut a pre-existing wall or a steel concrete form. Further, the panel element can be formed from multiple pieces, such as to form a corner of a concrete wall.

Figure 8:
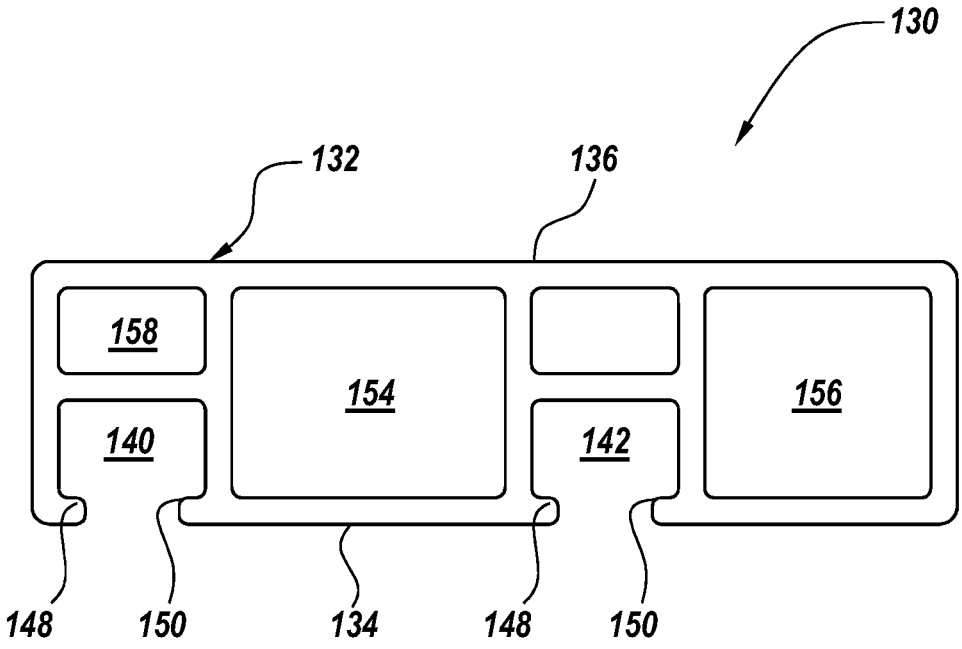
FIG. 8 is an alternate embodiment of the filler bar according to the teachings of the present invention.

FIG. 8 illustrates an alternate embodiment of the filler bar or panel assembly of the present invention. Like reference numerals denote like elements throughout the various views. The illustrated filler bar assembly includes a unitary filler bar 130 that is adapted to mount one or more of the bolt plate assemblies 38, 40 of the present invention. The filler bar 130 of the filler bar assembly of the current embodiment has a main body 132 that has a front surface 134 and an opposed rear surface 136. The main body 132 has first and second axially or longitudinally extending channels 140, 142 formed in the front surface 134. According to one practice, the channels 140, 142 are substantially the same and can have any selected shape or size, and preferably has a generally or substantially T-shaped configuration. Each of the channels has an opening that is formed in a front surface 134 of the main body 132. Each of the opening has a pair of opposed lip portions 148, 150 formed on either side of the opening and serves to function as a capture mechanism, along with the channel, to retain the bolt plate assembly 40. The main body also includes a series of hollows or chambers 154, 156, 158 that fill out the main body of the filler bar 130.

As illustrated, each channel 140, 142 of the filler bar 130 is adapted to mount a bolt plate assembly, similar in manner to that described above.

The illustrated filler bar 130, when the bolt plate assemblies are mounted thereto, can operate as a compete filler panel assembly without the need for a separate panel element or separate filler bar assemblies. The unitary main body of the filler bar 130 thus functions as the pair of filler bars and the panel element of FIGS. 1 and 2.

It will thus be seen that the invention efficiently attains the objects set forth above, among those made apparent from the preceding description. Since certain changes may be made in the above constructions without departing from the scope of the invention, it is intended that all matter contained in the above description or shown in the accompanying drawings be interpreted as illustrative and not in a limiting sense.

It is also to be understood that the following claims are to cover all generic and specific features of the invention described herein, and all statements of the scope of the invention which, as a matter of language, might be said to fall therebetween.

Having described the invention, what is claimed as new and desired to be secured by Letters Patent is:

1. A filler panel assembly for use with a concrete forming system, comprising one or more filler bar assemblies having a panel element disposed therebetween, wherein each of the filler bar assemblies is secured to the panel element, and wherein each of the filler bar assemblies includes a filler bar having a main body that extends in a longitudinal direction and has a front surface and an opposed rear surface, the main body having a flange portion that extends outwardly therefrom on one side of the filler bar, a longitudinally extending channel formed in the front surface, wherein the channel has an opening and the opening has a pair of opposed lip portions formed thereon on either side of the opening, and one or more bolt plate assemblies that include a bolt plate having a main body that has an aperture formed therein and a pair of opposed flanges that are formed in a front surface of the main body and which extend outwardly from a rear surface thereof, wherein the flanges are sized and configured for seating within the channel of the filler bar to position the bolt plate relative to the channel and enable the bolt plate to slide longitudinally along and within the channel so that a user can position the bolt plate assembly at a selected location along the channel, a nut element having a main body with an aperture formed therein, and wherein the nut element is sized and configured for seating within the channel of the filler bar, and a shoulder bolt element sized and configured for seating within the aperture of the bolt plate.

2. The filler panel of claim 1, wherein the flange portion has a front surface that has a plurality of fastener-receiving apertures formed therein for seating fasteners.

3. The filler panel of claim 2, wherein the fasteners secure the panel element to the flange portion of the filler bar.

4. The filler bar panel of claim 2, wherein the flange portion comprises a rear surface opposite the front surface that has an inset region formed therein.

5. The filler bar panel of claim 1, wherein the channel has a generally T-shaped configuration.

6. The filler bar panel of claim 1, wherein the opening of the channel and the pair of opposed lip portions form a capture mechanism to retain the bolt plate assembly.

7. The filler bar panel of claim 1, wherein the shoulder bolt element has a main body having a head portion and a shaft portion, wherein the shaft portion includes a non-threaded portion disposed adjacent the head portion and a distal threaded portion, and wherein the non-threaded portion of the shaft has a diameter that is greater than the diameter of the threaded portion of the shaft.

8. The filler bar panel of claim 1, further comprising a latch element having a main body having an aperture formed at one end of the main body that is adapted to seat a portion of the shaft of the shoulder bolt and one or more grooves, and wherein the latch element is adapted to freely swing when mounted to the shoulder bolt so as to seat on a shoulder bolt of an adjacent concrete form.

* * * * *